US009707489B2

(12) United States Patent
Nuttall et al.

(10) Patent No.: US 9,707,489 B2
(45) Date of Patent: Jul. 18, 2017

(54) PLAYSET WITH A PIVOTAL TRACK

(71) Applicant: Mattel, Inc., El Segundo, CA (US)

(72) Inventors: Michael Nuttall, South Pasadena, CA (US); Stacy O'Connor, El Segundo, CA (US)

(73) Assignee: Mattel, Inc., El Segundo, CA (US)

( * ) Notice: Subject to any disclaimer, the term of this patent is extended or adjusted under 35 U.S.C. 154(b) by 350 days.

(21) Appl. No.: 14/505,233

(22) Filed: Oct. 2, 2014

(65) Prior Publication Data

US 2015/0097042 A1 Apr. 9, 2015

Related U.S. Application Data

(60) Provisional application No. 61/886,364, filed on Oct. 3, 2013.

(51) Int. Cl.
*A63H 18/02* (2006.01)
*A63H 18/06* (2006.01)

(52) U.S. Cl.
CPC ..... *A63H 18/02* (2013.01); *A63H 18/06* (2013.01)

(58) Field of Classification Search
CPC .... A63H 18/02; A63H 18/023; A63H 18/025; A63H 18/026; A63H 18/028; A63H 18/06; A63H 18/16
USPC ..... 238/10 A
See application file for complete search history.

(56) References Cited

U.S. PATENT DOCUMENTS

| | | | | |
|---|---|---|---|---|
| 3,600,849 | A * | 8/1971 | Faller | A63H 18/14 446/429 |
| 4,094,089 | A | 6/1978 | Sano | |
| 4,383,688 | A | 5/1983 | Prehodka | |
| 4,536,168 | A | 8/1985 | Stephens | |
| 4,550,910 | A | 11/1985 | Goldfarb et al. | |
| 4,715,843 | A | 12/1987 | Ostendorff et al. | |
| 5,542,668 | A | 8/1996 | Casale et al. | |
| 5,683,298 | A | 11/1997 | Jackson | |
| 6,358,112 | B1 | 3/2002 | Lambert et al. | |
| 7,537,509 | B2 | 5/2009 | Payne et al. | |
| 7,549,906 | B2 | 6/2009 | Bedford et al. | |
| 7,628,674 | B2 | 12/2009 | Nuttall et al. | |
| 7,766,720 | B2 | 8/2010 | Ostendorff | |
| 7,794,301 | B2 | 9/2010 | Ostendorff et al. | |
| 7,857,679 | B2 | 12/2010 | O'Connor et al. | |
| 7,892,068 | B2 | 2/2011 | Nuttall et al. | |
| 7,934,970 | B2 | 5/2011 | OConnor | |
| 7,963,821 | B2 | 6/2011 | Ostendorff | |
| 8,182,308 | B2 | 5/2012 | Payne | |
| 8,192,246 | B2 | 6/2012 | Ostendorff et al. | |
| 8,256,721 | B2 | 9/2012 | O'Connor et al. | |
| 8,267,738 | B2 | 9/2012 | Nuttall | |
| 8,298,035 | B2 | 10/2012 | O'Connor | |
| 8,322,660 | B2 | 12/2012 | O'Connor | |
| 8,382,553 | B2 | 2/2013 | O'Connor | |

(Continued)

*Primary Examiner* — Zachary Kuhfuss
(74) *Attorney, Agent, or Firm* — Edell, Shapiro & Finnan, LLC

(57) ABSTRACT

A playset including a track is provided. The track may include a main section and a pivotal section. In a first mode, the pivotal section may be triggered to disconnect from the main portion to cause an object travelling on the track to be launched or disconnected from the track. In a second mode, the pivotal section may be triggered to disconnect from the main portion to cause a projection extending from the pivotal portion to pin the object to the track.

20 Claims, 12 Drawing Sheets

(56) References Cited

U.S. PATENT DOCUMENTS

| | | | |
|---|---|---|---|
| 8,449,344 | B2 | 5/2013 | Nuttall et al. |
| 2005/0287914 | A1 | 12/2005 | Sheltman et al. |
| 2005/0287915 | A1 | 12/2005 | Sheltman et al. |
| 2011/0269371 | A1 | 11/2011 | Nuttall et al. |
| 2011/0294396 | A1 | 12/2011 | O'Connor et al. |
| 2012/0052766 | A1 | 3/2012 | Payne |
| 2012/0164914 | A1 | 6/2012 | O'Connor et al. |
| 2012/0309263 | A1 | 12/2012 | Lennon et al. |
| 2012/0322342 | A1 | 12/2012 | De La Torre |
| 2013/0052913 | A1 | 2/2013 | Schmid et al. |

* cited by examiner

PLAYSET WITH A PIVOTAL TRACK

CROSS-REFERENCE TO RELATED APPLICATIONS

This application claims priority under 35 U.S.C. §119(e)(1), to U.S. Provisional Application Ser. No. 61/886,364, filed on Oct. 3, 2013, the entire contents of which is incorporated herein by reference.

FIELD

Embodiments relate to toy playsets and, more particularly, to a playset with a pivotal track portion.

BACKGROUND

Track playsets generally provide a course for movement of objects. For example, automobile track playsets may allow the user to race or navigate a replica automobile along a guided path. Some courses may elevate the user experience by adding obstacles or fantastic elements to the track, such as, for example, loops or gaps which may be traversed along the course to provide a sense of excitement, enhance the user experience, and increase popularity.

SUMMARY

In one embodiment, a toy vehicle playset may include a track having a main portion and a pivotal portion, a projection coupled to the pivotal portion of the track, and a first trigger coupled to the pivotal portion of the track, the first trigger configured to disconnect the pivotal portion from the main portion and move the projection into a pinning position to pin an object.

In another embodiment, a toy vehicle playset may include a track having a main section and a pivotal section, the main section including an exit portion and a re-entry portion, the pivotal section including a first end and a second end, the first end of the pivotal section being connected to the exit portion of the main section and the second end of the pivotal section being connected to the re-entry portion of the main section, a projection coupled to the first end of the pivotal section, a latching mechanism retaining the pivotal section in a position relative to the main section, and a trigger positioned along the track and configured to interact with an object passing along the track, wherein activation of the trigger results in the release of the latching mechanism, thereby allowing the pivotal section to rotate relative to the main section, the projection engages the object when the pivotal section rotates relative to the main section.

In another embodiment, a method of using a toy vehicle playset, the toy vehicle playset including a track with a main section and a pivotal section, the track including a trigger coupled thereto, may include cocking the trigger positioned along the track, guiding an object from the main section of the track to the pivotal section of the track, detecting a triggering action generated as the object moves along the track and rotating the pivotal section away from the main section of the track in response to the detected triggering action, and pinning the object to the track.

These and other features, aspects and advantages as broadly described herein will become better understood with reference to the following drawings, description and claims.

BRIEF DESCRIPTION OF THE DRAWINGS

Example embodiments will become more fully understood from the detailed description given herein below and the accompanying drawings, wherein like elements are represented by like reference numerals, which are given by way of illustration only and thus are not limiting of the example embodiments and wherein.

Figure 1:
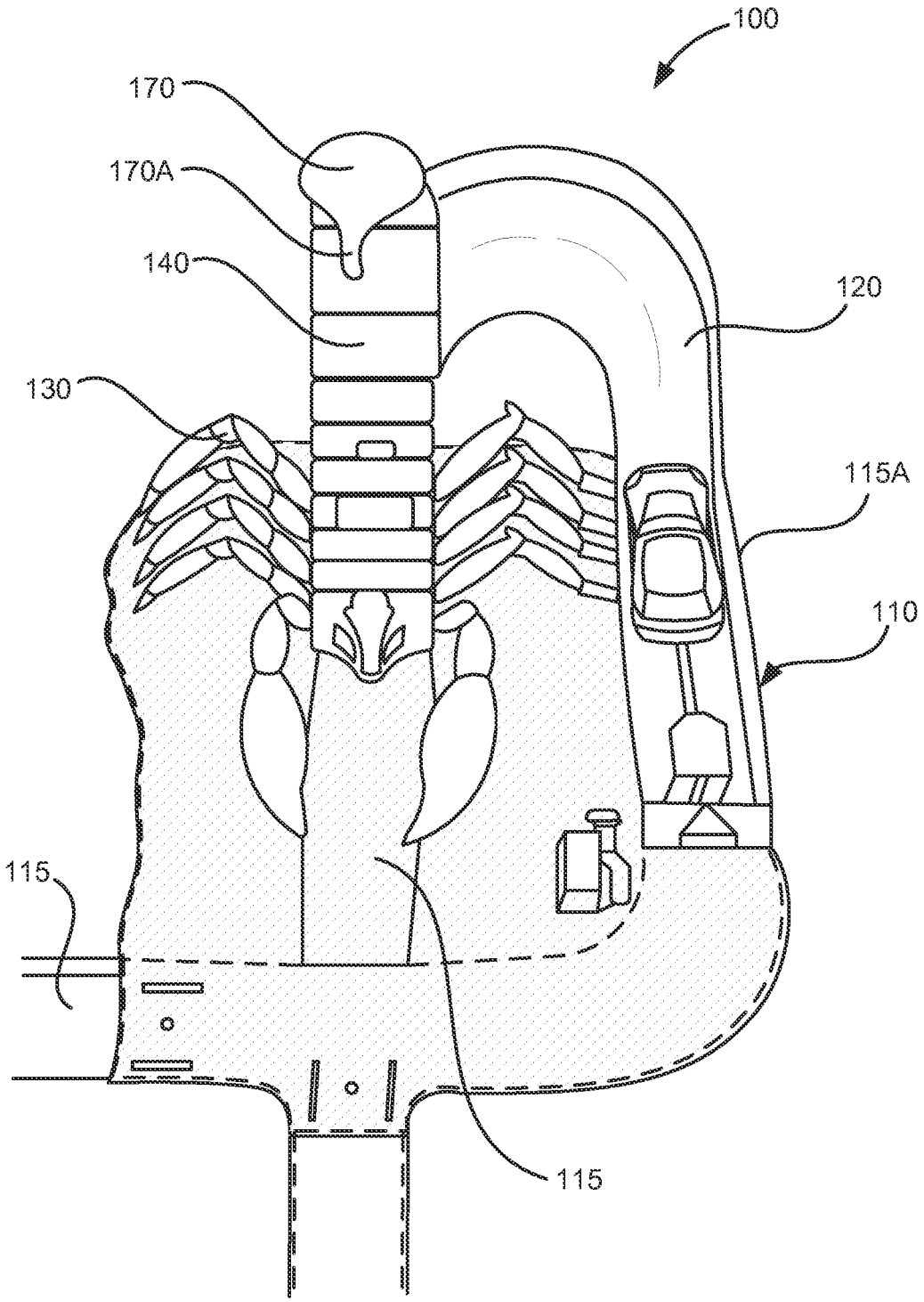
FIG. 1 is a top perspective top view of a playset in accordance with an exemplary embodiment.

It should be noted that these figures are intended to illustrate the general characteristics of methods, structure and/or materials utilized in certain example embodiments and to supplement the written description provided below.

DETAILED DESCRIPTION OF THE EMBODIMENTS

While example embodiments may include various modifications and alternative forms, embodiments thereof are shown by way of example in the drawings and will herein be described in detail. It should be understood, however, that there is no intent to limit example embodiments to the particular forms disclosed, but on the contrary, example embodiments are to cover all modifications, equivalents, and alternatives falling within the scope of the claims.

The following detailed description presents various exemplary embodiments and is not to be taken in a limiting sense, but is made merely for the purpose of illustrating the general principles as broadly described herein, with scope defined by the appended claims.

Various features are described below that can each be used independently of one another or in combination with other features. However, any single feature may not address any of the problems discussed above or may only address one of the problems discussed above. Further, one or more of the problems discussed above may not be fully addressed by any of the features described below.

A playset for moving objects around a track is provided. The track may include a pivotal portion that may disconnect from the main track to provide the appearance of a thematic element, such as, for example, a creature, flipping or trapping the object as it travels along a portion of the creature.

Figure 2:
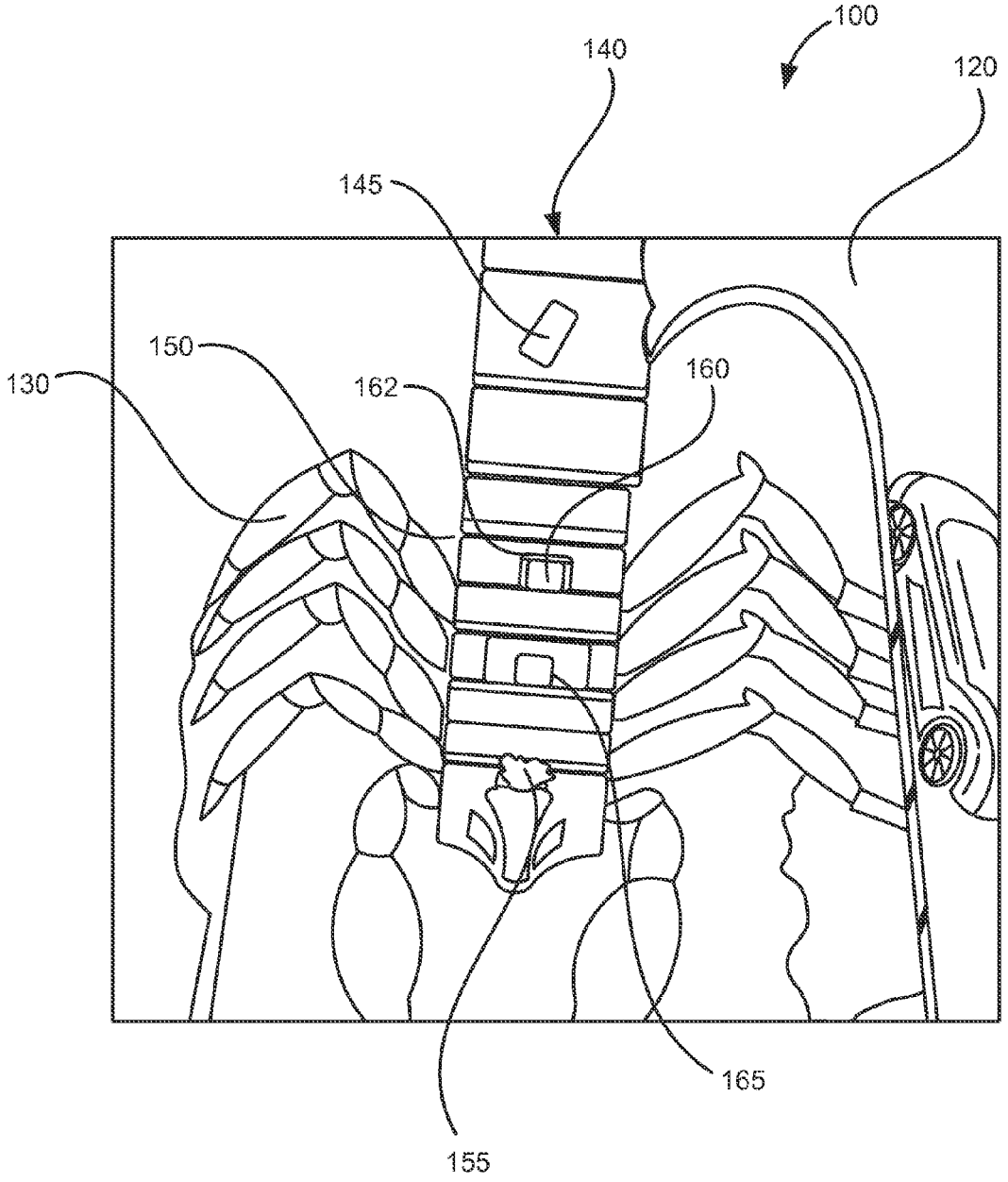
FIG. 2 is an enlarged view of a portion of the playset of FIG. 1.

Referring now to FIGS. 1-2, a playset 100 is shown in accordance with an exemplary embodiment. The playset 100 may generally include a track 110. The track 110 may include a main portion or main section 115, and a secondary or flipping/trap portion or section 130. The flipping/trap section 130 may be considered an auxiliary track section that is connected to the main section 115 of the track 110. For example, an exit portion 115*a* of the main section 115 of the track 110 may guide an object, such as, for example, a toy vehicle, from the main section 115 of the track 110 into the flipping/trap section 130. After the object has passed through the flipping/trap section 130, the object may re-enter the main section 115 of the track 110 via a re-entry portion 115*b* of the main section 115 of the track 110.

The flipping/trap section 130 may have a theme. For example, the flipping/trap section 130 may provide an auxiliary feature along the track 110 resembling a creature incorporated into the track 110. The object may travel along the track 110 and, in some embodiments, upon leaving the main section 115 of the track 110, may enter a curve 120 which may lead to the flipping/trap section 130. The flipping/trap section 130 may resemble, for example, a scorpion, as shown in the exemplary embodiment of FIG. 1, so that the object may travel along the body of the scorpion to potentially trigger one or more events. In other embodiments, the flipping/trap section 130 may resemble other creature(s) and/or thematic elements, in keeping with an overall theme of the particular playset.

In an exemplary embodiment, the flipping/trap section 130 of the track 110 may include a pivotal portion or pivotal section 140. In an initial, at rest position, the pivotal section 140 may generally be in a default or retracted position, aligned with the track 110, so that the object may temporarily exit the main section 115 of the track 110 via the exit portion 115*a* and travel along the pivotal portion 140 and into a transition portion or section 150, as shown in FIG. 2, before returning, under certain circumstances, to the main section 115 of the track 110 via the re-entry portion 115*b*. The transition section 150 may be fixed in position to receive the object as it exits the pivotal section 140 and guide the object back into the main section 115 of the track 110 via the re-entry portion 115*b*. The transition section 150 may resemble, for example, a part of the creature or other thematic element as appropriate, such as the torso or thorax of a scorpion as shown in the exemplary embodiment.

As shown in FIG. 2, a hinge 165 may couple the pivotal section 140 to the transition section 150. In some embodiments, the pivotal section 140 may be spring biased and held in a retracted state by a latch 160 and a catch 162. In some embodiments, the latch 160 may be incorporated into or coupled to the transition section 150 while the catch 162 may be integral with or coupled to the pivotal section 140. In other embodiments, the latch 160 may be incorporated into or coupled to the pivotal section 140 and the catch 162 may be incorporated into or coupled to the transition section 150.

The pivotal section 140 may include a projection 170, as shown in FIG. 1. In some embodiments, the projection 170 may be disposed at an end of the pivotal section 140. For example, in embodiments resembling a scorpion, the projection 170 may resemble a stinger, and part of the pivotal section 140 (not directly in the path of the object) may be curved to form the stinger. At least a portion of the projection 170 may include a soft rubber tip or portion 170*a*.

Figure 8A:
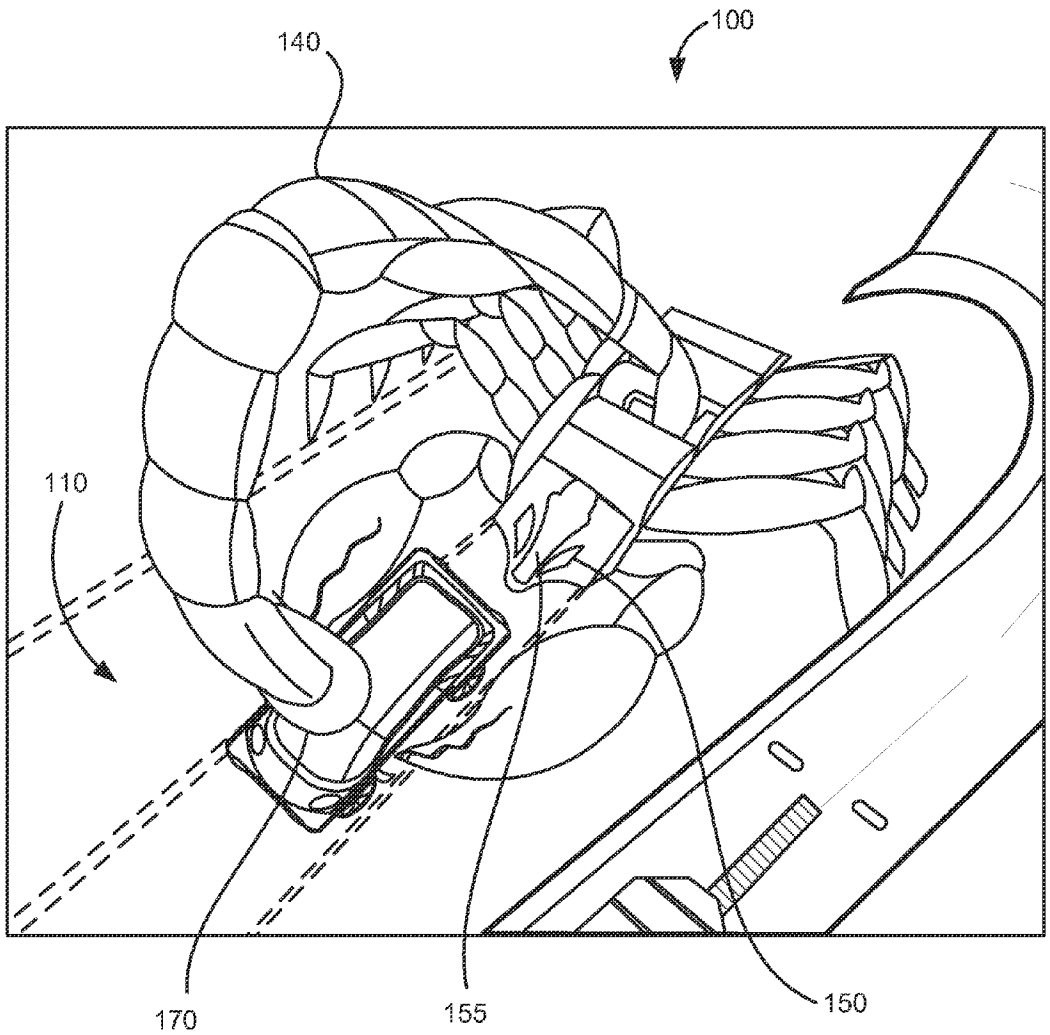
FIG. 8A is a top perspective view of the playset of FIG. 1, pinning an object.
Figure 8B:
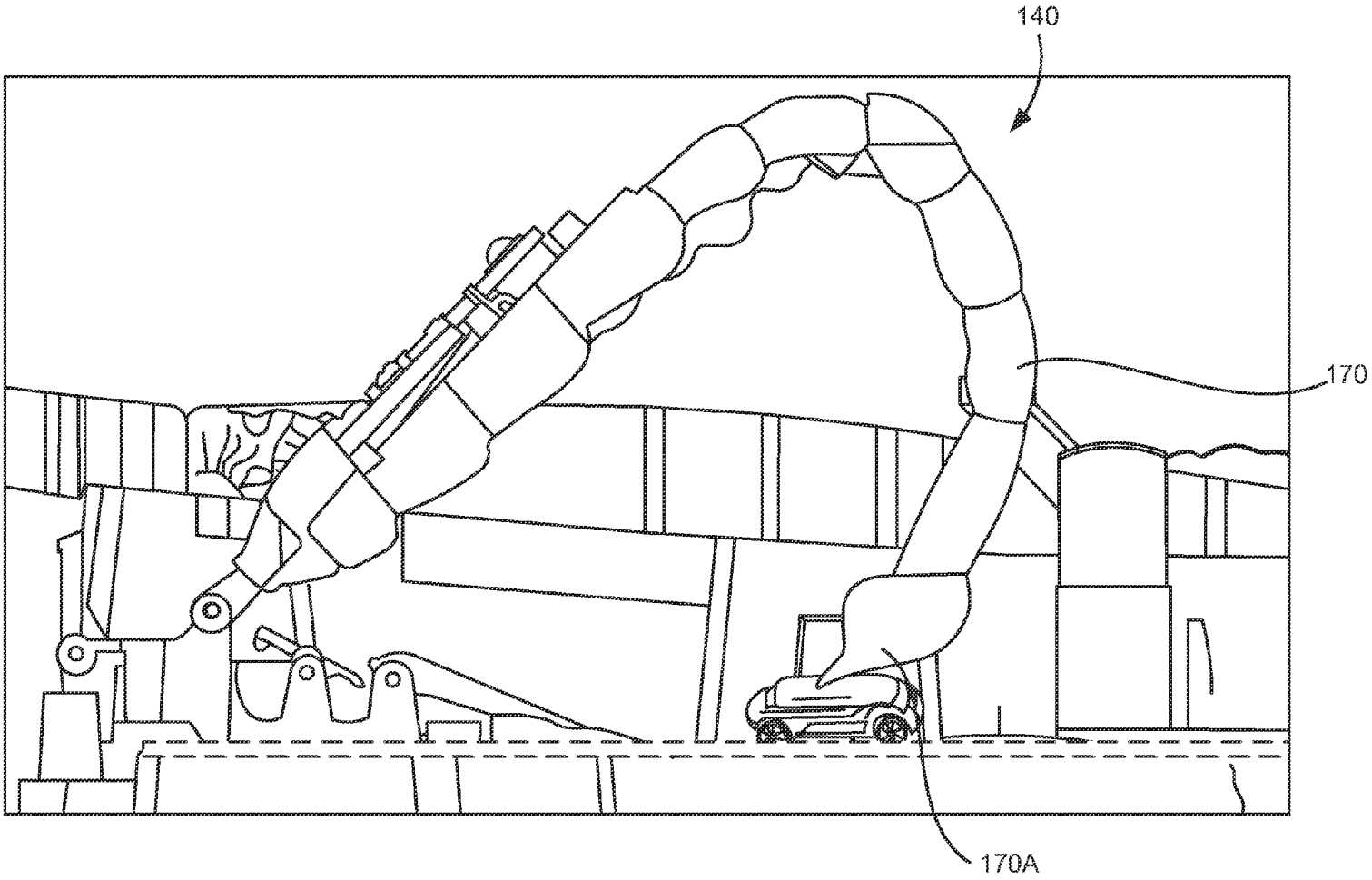
FIG. 8B is a side view of the playset of FIG. 1, pinning an object.

The pivotal section 140 may, under some conditions, flip the object from the track 110. Under other conditions, the pivotal section 140 may release the projection 170 from the refracted position into a pinning position, thereby pinning the object on the track 110 as shown in FIGS. 8A and 8B, for example, just beyond the transition section 150 as the object exits the flipping/trap section 130 and approaches a return into the main section 115 of the track 110 via the re-entry portion 115*b*.

As shown in FIG. 2, the pivotal section 140 may include a first trigger 145, and the transition section 150 may include a second trigger 155. Actuation of the first trigger 145 by the object as it moves along the pivotal section 140 may result in a first event, for example, flipping the object from the track 110. Actuation of the second trigger 155 by the object may result in a second event, for example, trapping or pinning the object on the track 110 as the object exits the flipping/trap section 130, as shown in FIGS. 8A and 8B. The first trigger 145 and the second trigger 145 may extend up from the road surface of track 110, so as to form an obstacle as the object travels through the corresponding portion of the track 110. As the object collides with one of the triggers 145/155, the trigger is actuated, triggering the corresponding event.

Figure 3A:
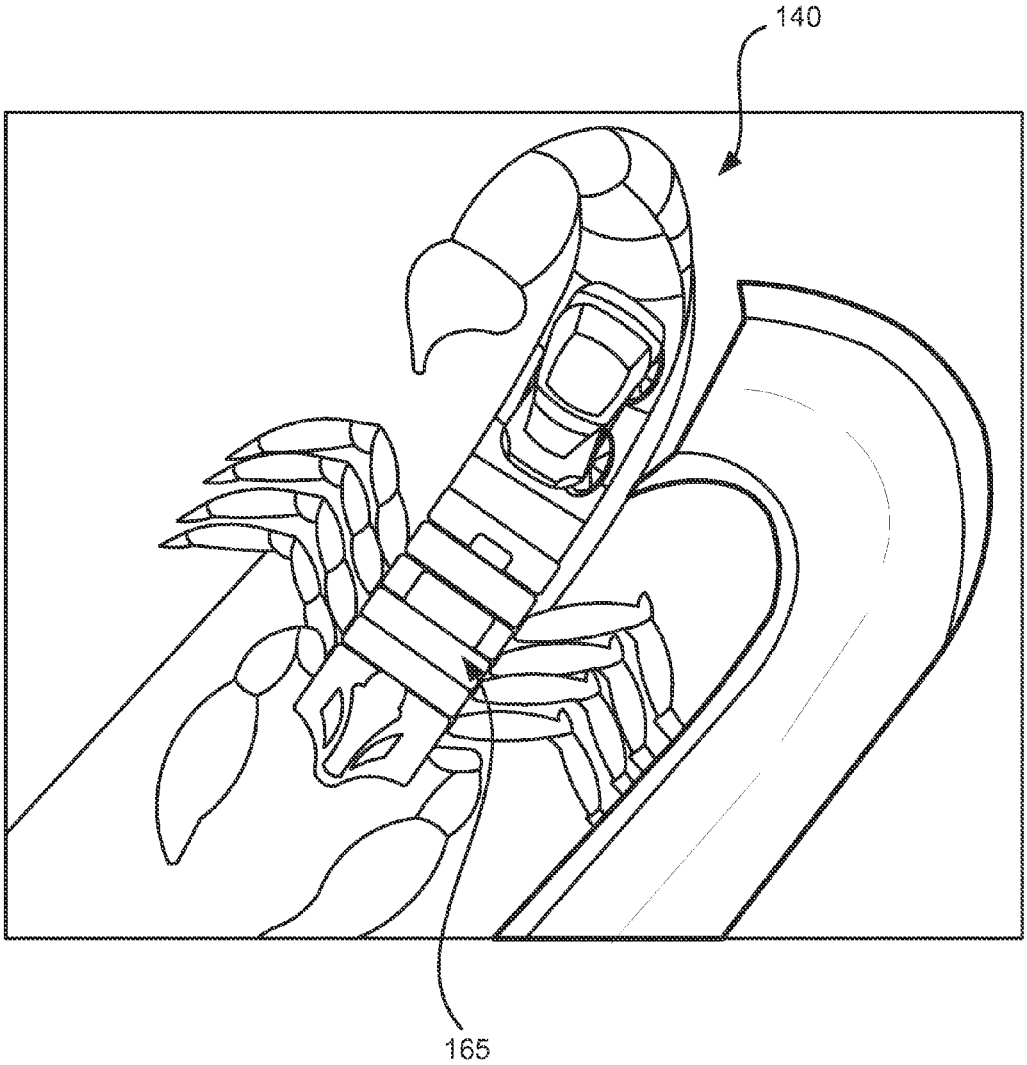
FIGS. 3A and 3B are top perspective views of the playset of FIG. 1 showing a flipping action of a pivotal portion of the playset.
Figure 3B:
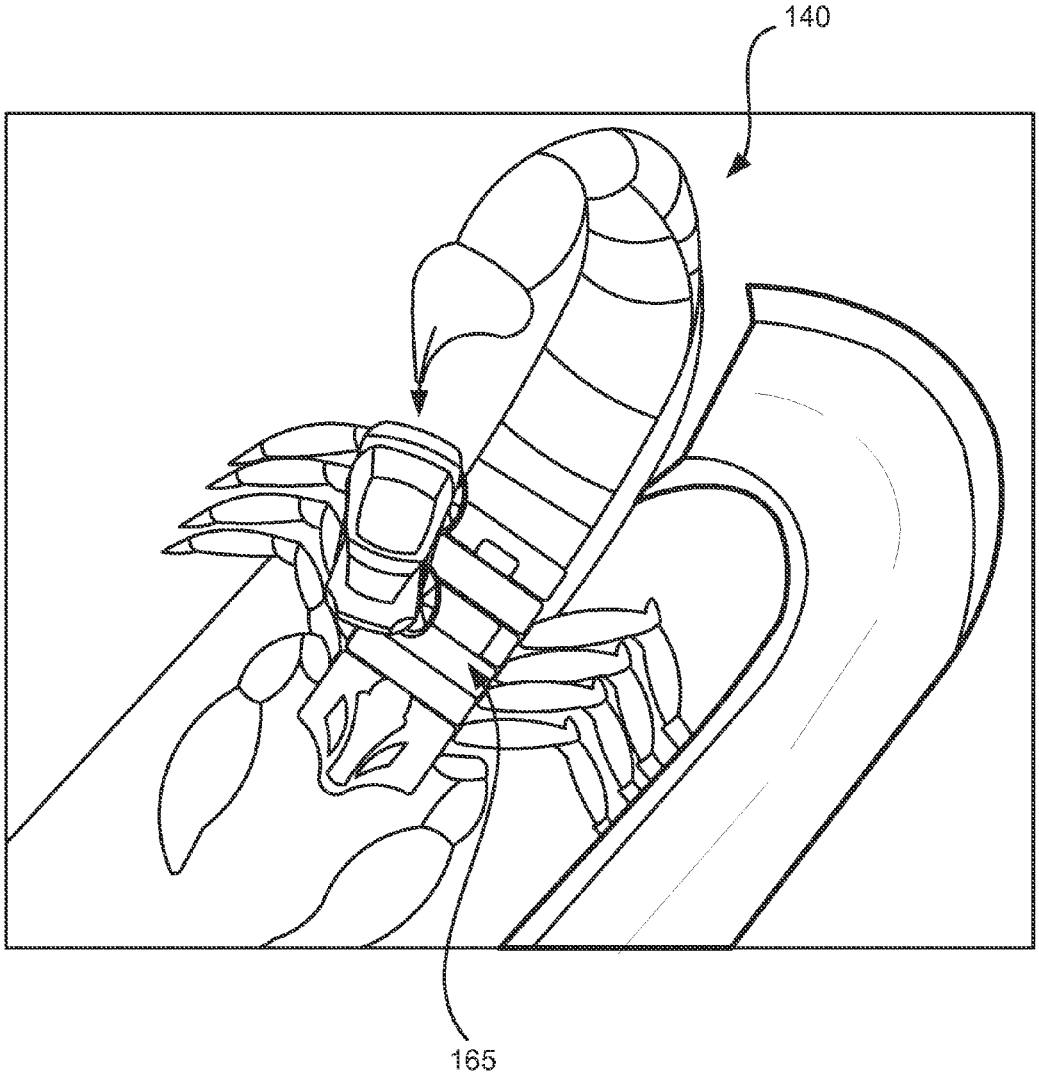
Figure 4:
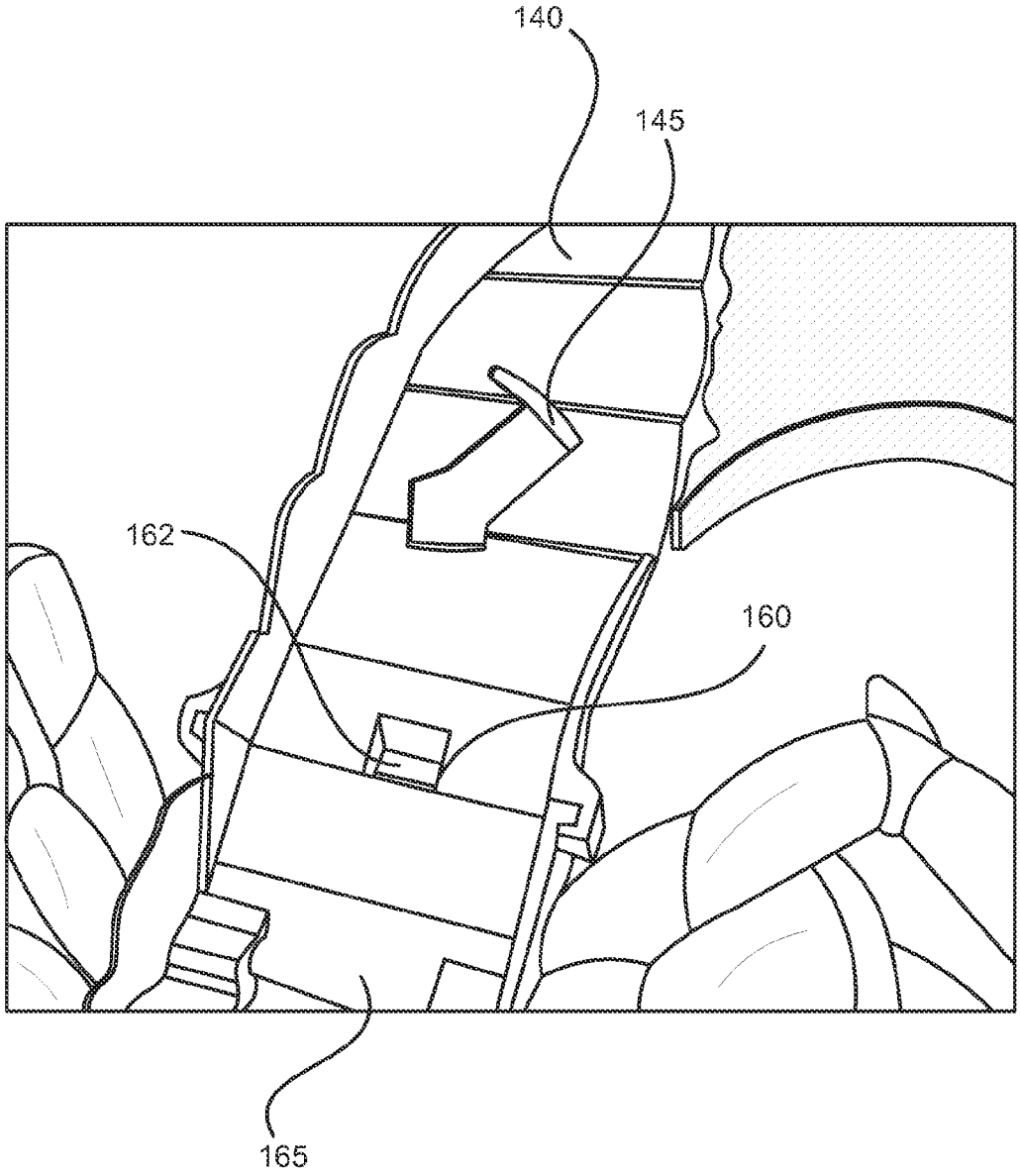
FIG. 4 is an enlarged front view of the pivotal portion shown in FIG. 3.

Referring now to FIGS. 3A-3B and 4, the pivotal section 140 is further described with respect to flipping an object. In FIG. 3A, the pivotal section 140 has been released from the retracted position and disconnected from the main portion 115 in response to a triggering of the first trigger 145, for example, by the object passing over/colliding with the first trigger 145. In particular, FIG. 3A shows the pivotal section 140 in a rotated state, with a first end of the pivotal section 140 rotated about a hinge 165 at second/opposite end thereof, so that the first end of the pivotal section 140 is separated from the curve 120 leading into the pivotal portion 140. FIG. 3B shows the object separated from, or launched from, or thrown from, the track. As shown in FIG. 3B, when separating the object from the pivotal section 140 of the track 110, the rotation of the pivotal section 140 in this manner, combined with the arcuate path of the pivotal section 140 as it rotates, may cause the object to flip or turn over as it is separated from or launched from the track 110.

In some embodiments, the first trigger 145 may be operably coupled to the latch 160. When the pivotal section 140 is in the retracted position shown in FIGS. 1 and 2, aligned with the exit portion 115*a* of the main section 115 of the track 110 to allow the object to travel into the pivotal section 140, the first trigger 145 may be cocked. Cocking of the first trigger 145 may be done by the user, in advance of play, when the user wants to flip the object from the track 110, by actuating a release mechanism shown in FIG. 7B to engage the latch 160. For example, cocking of the first trigger 145 may cause the first trigger 145 to form an obstruction on the track, in the path of the object, so that the object may engage or interact with the first trigger 145 when travelling on the pivotal section 140, thereby releasing the latch 160 from the catch 162 by means of the release mechanism. In response to the release of the latch 160 from the catch, the pivotal section 140 may move from its retracted position, rotating about the hinge 165, so that the second end of the pivotal section 140 follows as generally arcuate path as it moves toward the second trigger 155 with the object is on the pivotal section 140. This movement causes the object to be launched or separated from the pivotal section 140 of the track 110, in the general direction of the second trigger 155, thereby flipping the object from the track 110. As the projection 170 is attached to/extends outward from the second end of the pivotal section 140, the projection moves in a similar manner, together with the pivotal section 140, following a similar path.

When a user wishes to avoid the flipping action, the first trigger 145 may be uncocked in advance of the object reaching the first trigger 145. In the uncocked state, the first trigger 145 may no longer be an obstruction on the pathway along the pivotal section 140, the latch 160 may remain engaged with the catch 162 as the object passes the area of the first trigger 145, and the object may remain on the track without being launched or separated from the track.

Figure 5:
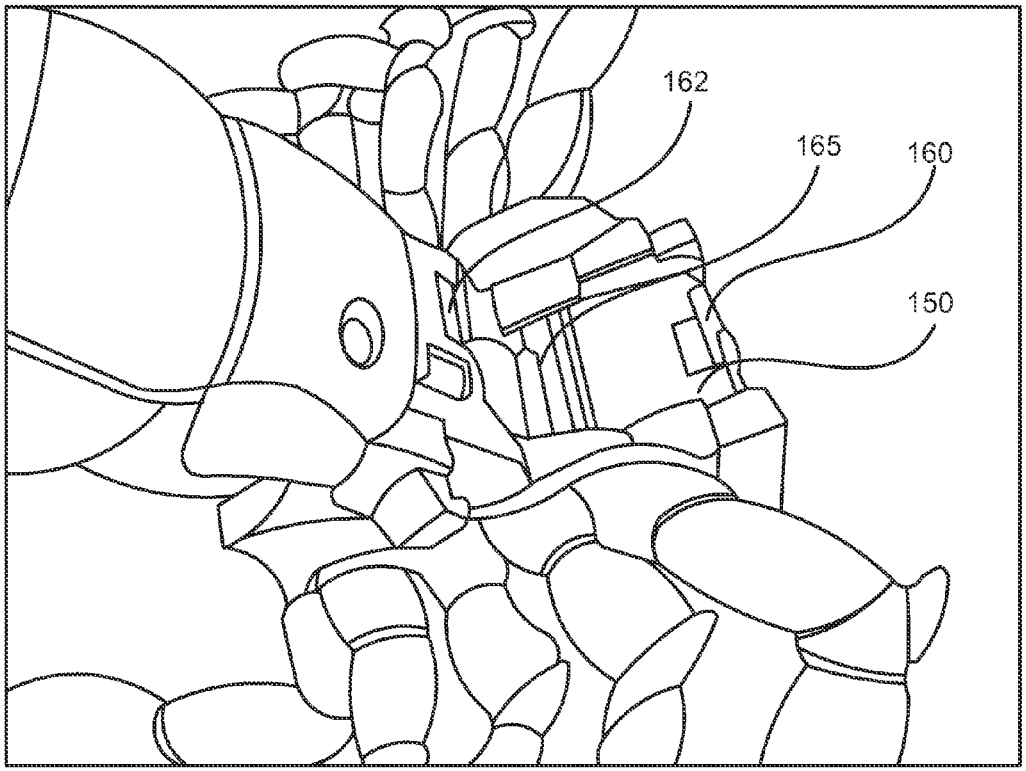
FIG. 5 is an enlarged rear view of the pivotal portion shown in FIG. 4, in a released state.

FIG. 5 shows a rear perspective view of the pivotal section 140 and pivoted about the hinge 165 and rotated towards the second trigger 155 after the pivotal portion 140 is released from the refracted state. The latch 160 may remain in place as part of the transition section 150 while the catch 162 is disconnected from the latch 160.

Figure 6:
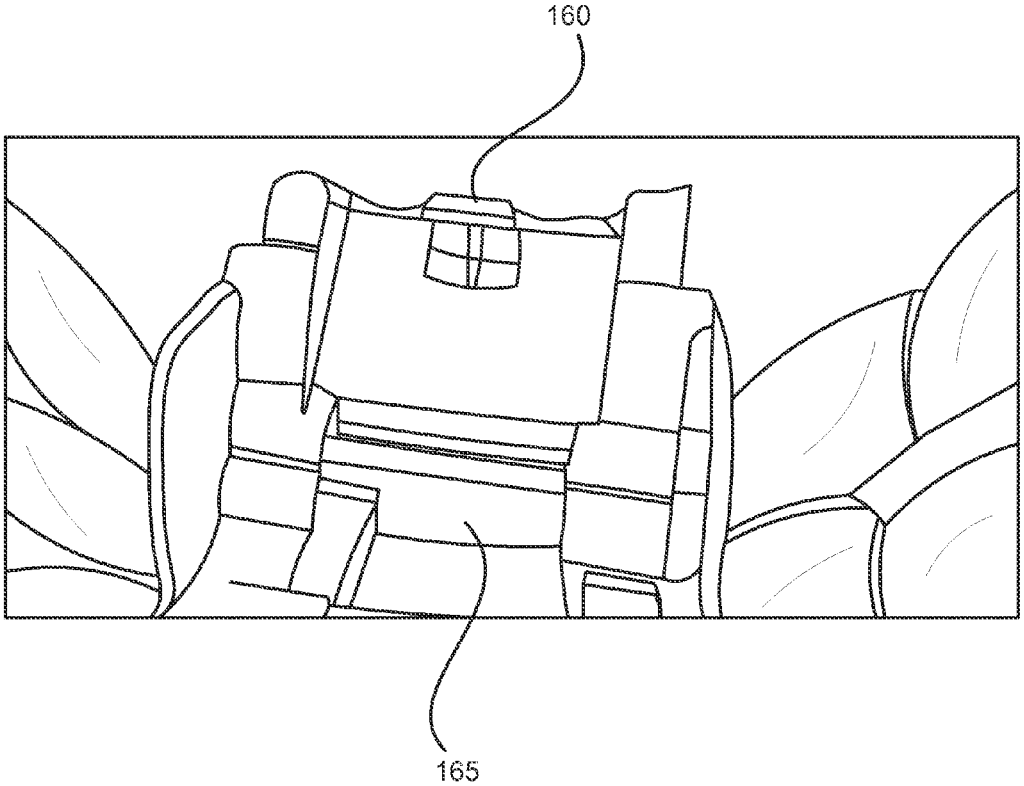
FIG. 6 is a top perspective view of a latch and hinge of the pivotal portion shown in FIG. 5.

FIG. 6 shows a top perspective view of the latch 160 adjacent the hinge 165. The latch 160 may be, for example, a projecting detent which may be press fit into the catch 162 as shown in FIG. 5 to hold the pivotal section 140 in the retracted position. The latch 160 may be slid out of contact with the catch 162 when either the first trigger 145 or the second trigger 155 is actuated.

Figure 7A:
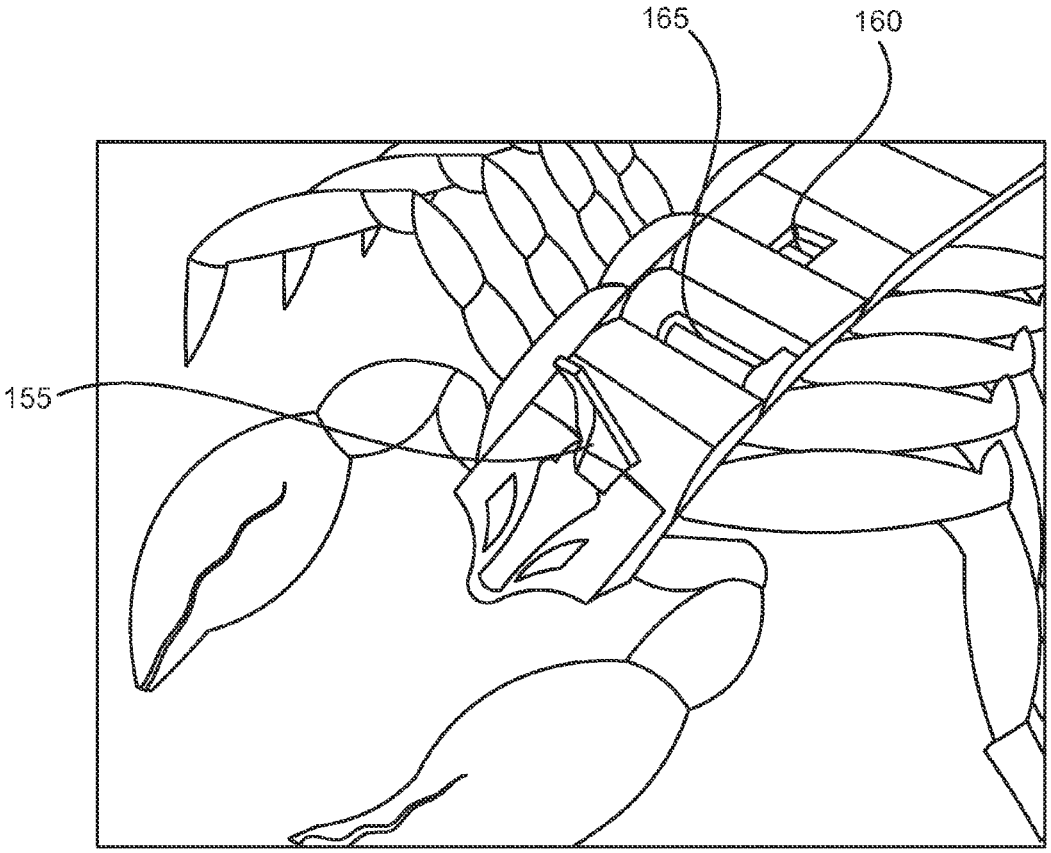
FIG. 7A is an enlarged front view of a trigger for actuating a pinning action of the pivotal portion of the track of the playset shown in FIG. 1.

Referring now to FIG. 7A, the second trigger 155, which may actuate the trapping/pinning event or condition, is shown in accordance with an exemplary embodiment. The second trigger 155 may be cocked into an obstruction position on the transition section 150 which, in response to engagement or interaction or collision with the object, may actuate a release mechanism to disengage the latch 160 and allow the pivotal section 140 to rotate in the manner described above.

Figure 7B:
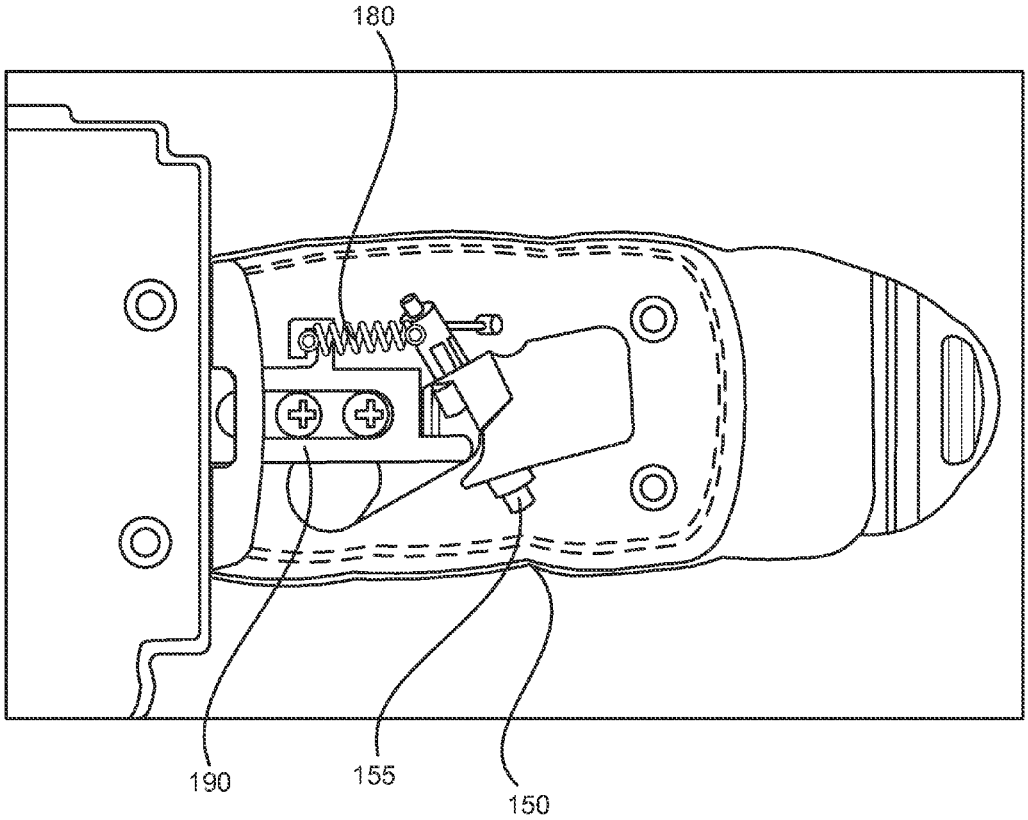
FIG. 7B is a bottom view of a transition section of the track, illustrating a linking mechanism.

FIG. 7B is a bottom view of the transition section 150 of the track 110. FIG. 7B illustrates an exemplary mechanism which may operably couple the second trigger 155 to the spring biased hinge 165, and which may transmit the actuation of the second trigger 155 by the object on the track 110 to release the spring biased hinge 165, allowing the pivotal section 140 of the track 110 to rotate in response to the actuation of the second trigger 155. In this exemplary arrangement, a spring 180 may have a first end connected to a portion of the second trigger 155, and a second end connected to a link 190 coupled between the second trigger 155 and the hinge 165. The second trigger 155 may be rotatably coupled at an underside of the track 110, with an obstacle end of the second trigger 155 extending up through the track 110. To cock the second trigger 155, the user may rotate the obstacle end of the second trigger 155 from an uncocked position, in which the second trigger 155 is laying down, substantially flush with the surface of the track 110 on which the object travels, to a cocked position in which the second trigger 155 stands upright and presents an obstacle to the progress of the object along a corresponding portion of the track 110. Interaction, or collision, between the object and the second trigger 155 in the upright, cocked position, may move the link 190 and release the spring/hinge from the biased position, causing the pivotal section 140 to rotate as described above.

Although not shown in detail, it may be understood that a similar mechanism may be applied to the cocking, actuation and triggering of the first trigger 145, and the resulting rotation of the projection 170 about the hinge 165.

As noted above, the first trigger 145 and the second trigger 155 may be cocked individually, by the user, in advance of play, based on the desired flipping or pinning action. For example, if the user wishes to cause the object to be separated from the track as it passes through the pivotal section 140, the user may lift the first trigger 145 to the upright, cocked position, as shown in, for example, FIG. 4, so that the pivotal section 140 rotates upon contact with the first trigger 145 to launch the object from the track. In this situation, as the object is flipped before reaching the second trigger 155, the second trigger 155 may be cocked or uncocked. If, instead, the user wishes to pin the object to the track, the user may uncock the first trigger 145, laying the first trigger 145 down, into a recess in the track so that it is flush with the track, and cock the second trigger 155, so that the second trigger 155 is in the upright, cocked position, as shown in, for example, FIG. 7B. This may allow the object to pass the first trigger 145 and reach the second trigger 155, so that the rotation of the pivotal section 140 is not actuated until the object has reached the transition section 150 and may be pinned by the rotation of the projection 170. To allow the object to exit the main section 115 of the track 110 through the exit portion 115*a*, pass through the flipping/trap section 130 of the track 110 without being separated from or pinned to the track 110, and re-enter the main section 115 of the track 110 via the re-entry portion 115*b*, the user may uncock both the first trigger 145 and the second trigger 155, so that the first and second triggers 145 and 155 are both flush with the track, and neither of the triggers pose an obstacle in the path of the object that would trigger rotation of the pivotal section 140.

Thus, in some embodiments, when the second trigger 155 is cocked, the first trigger 145 is uncocked, allowing the object to pass along the pivotal section 140 and into the transition portion 150 without the object being flipped. As the object engages or interacts or collides with the cocked second trigger 155, the latch 160 may release from the catch 162 and the pivotal section 140 may pivot about the hinge 165 as shown in FIGS. 5 and 6. The projection 170 may move or spring towards the second trigger 155 as the latch 160 is released, together with the pivotal section 140, and to, for example, the track 110 just beyond the transition section 150, to pin the object between the projection 170 and the track 110. As shown in FIGS. 8A and 8B, in the pinning position, the projection 170, and in particular, the tip 170*a* of the projection 170, may be positioned on the top of the object, holding the object in place on the track 110 as it attempts to re-enter the main section 115 of the track 110 via the re-entry portion 115*b* of the main section 115 of the track 110. As the projection 170 rotates together with the pivotal section 140, the projection 170 essentially impacts the top of the object to pin the object to the track 110. However, because the tip 170*a* of the projection 170 is made of a relatively soft material, such as, for example, rubber, this impact does not damage the object.

In embodiments resembling a scorpion, this type of action may provide the appearance of the object being stung, providing an exciting enhancement to the toy automobile experience. However, as noted above, the projection 170, when employing a soft rubber tip 170*a*, may not damage the object when pinning the object in this manner.

An exemplary process for operating the playset shown in FIGS. 1-8, summarizing the features described above, is provided in FIG. 9.

As described above, the first trigger 145 and the second trigger 155 may be individually/selectively cocked or uncocked, based on the desired outcome. More specifically, if the user would like to cause the object traveling along the track 110 to be separated/launched from the pivotal section 140 of the track 110, the user may cock at least the first trigger 145. If the user would like to cause the object traveling along the track 110 to be pinned to the track 110, the user may uncock the first trigger 145 and cock the second trigger 155. If the user would like the object to pass through the flipping/tracking section 130 of the track 110 unabated, the user may uncock both the first trigger 145 and the second trigger 155, to allow the object to leave the main section 115 of the track 110 via the exit portion 115*a*, pass through the flipping/trap section 130, and re-enter the main section 115 of the track 110 via the re-entry portion 115*b*.

Figure 9:
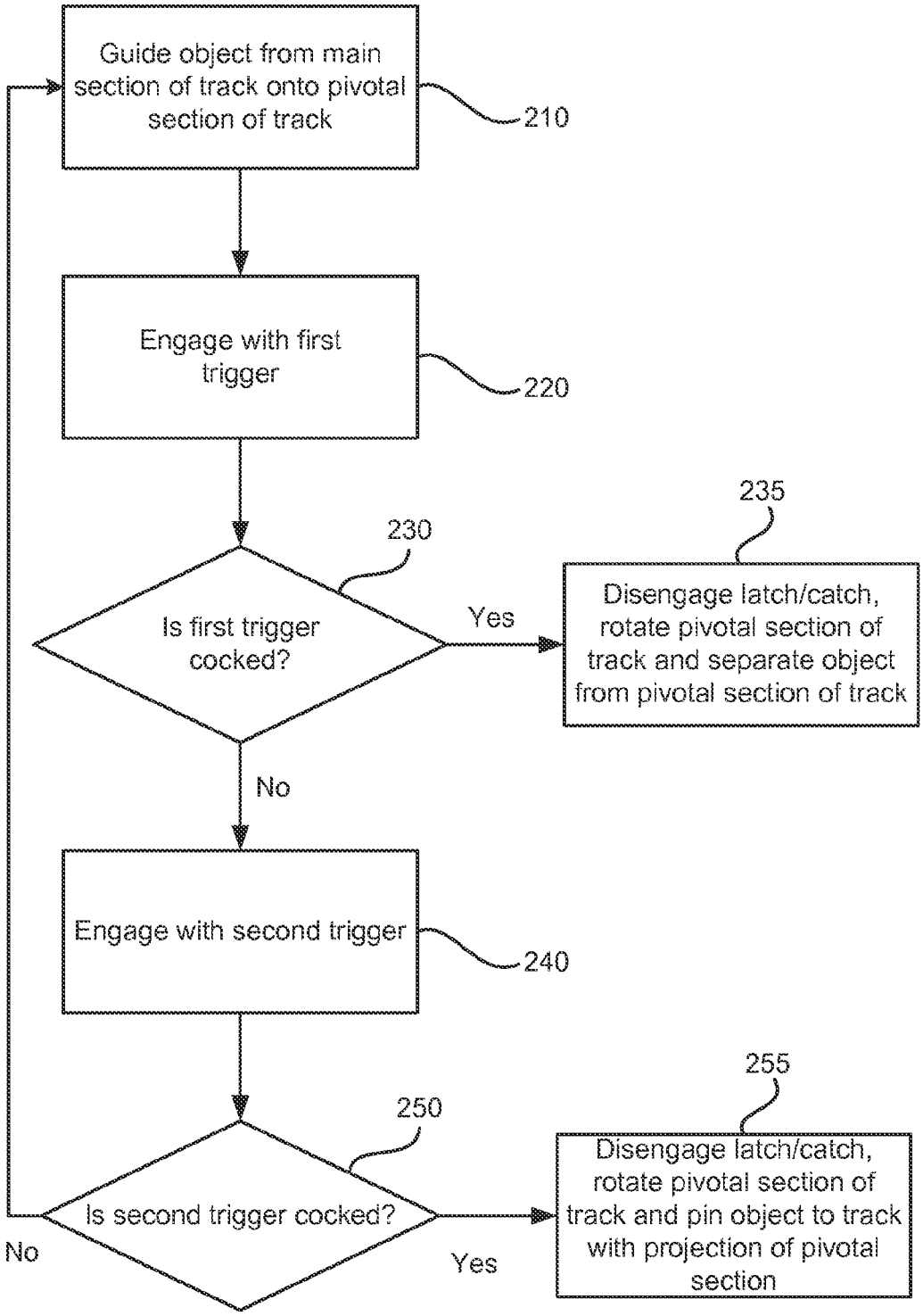
FIG. 9 is a flowchart of an exemplary process for operating the playset shown in FIG. 1.

As shown in FIG. 9, first, at step 210, the object, or vehicle, is launched on the main section 115 of the track 110, and then leaves the main section 115 of the track 110 via the exit portion 115*a* and enters the pivotal section 140 of the track. If the first trigger 145 has been cocked by the user in advance of play, indicating that the user would like the object to be separated/launched from the track 110, then when the object passes in the vicinity of the first trigger 145 and collides with or otherwise interacts with the first trigger 145 at step 220, if it is determined that the first trigger 145 is cocked at step 230, the latch 160 is disengaged from the catch 162, actuating the latch mechanism and releasing the spring biased hinge 165 so that the pivotal section 140 of the track 110 rotates about the hinge 165 and separates, or launches, the object from the track 110 at step 235.

If the first trigger 145 is not cocked when the object in the vicinity of the first trigger 145, the object proceeds along the pivotal section 140 of the track 110 and into the transition section 150. When the object collides with or otherwise interacts with the second trigger 155 at step 240, and it is determined that the second trigger 155 is cocked at step 250, then at step 255 the latch 160 may be disengaged from the catch 162. This may actuate the latch mechanism and so that the pivotal section 140 of the track 110 rotates about the hinge 165, with the projection 170 rotating with the pivotal section 140, causing the tip 170*a* of the projection 170 pins the object between the tip 170*a* of the protrusion 170 and the track 100 (145), restraining/pinning/trapping the object and keeping it from re-entering the main section of the track 110.

If neither the first trigger 145 nor the second trigger 155 was cocked by the user in advance of play, indicating the user would like the object to pass through the flipping/trap section 130 unabated, the object may proceed from the end of the flipping/trap section 130 back into the main section 115 of the track 110 via the re-entry portion 115*b*.

It will be understood that the foregoing relates to exemplary embodiments and that modifications may be made without departing from the spirit and scope as broadly described herein.

Specific structural and functional details disclosed herein are merely representative for purposes of describing example embodiments. Example embodiments, however, be embodied in many alternate forms and should not be construed as limited to only the embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments. As used herein, the term "and/or" includes any and all combinations of one or more of the associated listed items.

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "includes" and/or "including," when used herein, specify the presence of stated features, steps, operations, elements and/or components, but do not preclude the presence or addition of one or more other features, steps, operations, elements, components and/or groups thereof.

It should also be noted that in some alternative implementations, the functions/acts noted may occur out of the order noted in the figures. For example, two figures shown in succession may in fact be executed concurrently or may sometimes be executed in the reverse order, depending upon the functionality/acts involved.

Lastly, it should also be noted that whilst the accompanying claims set out particular combinations of features described herein, the scope of the present disclosure is not limited to the particular combinations hereafter claimed, but instead extends to encompass any combination of features or embodiments herein disclosed irrespective of whether or not that particular combination has been specifically enumerated in the accompanying claims at this time.

What is claimed is:

1. A toy vehicle playset, comprising:

a track having a main portion and a pivotal portion coupled to the main portion;

a projection coupled to the Pivotal portion of the track; and a first trigger coupled to the pivotal portion of the track, the first trigger configured to disconnect part of the pivotal portion from the main portion and allow the projection and the pivotal portion to move relative to the main portion into a pinning position to pin an object to the main portion of the track.

2. The toy vehicle playset of claim 1, further comprising a second trigger coupled to the pivotal portion, the second trigger configured to disconnect part of the pivotal portion from the main portion and allow the pivotal portion to flip the object from the track.

3. The toy vehicle playset of claim 2, wherein the second trigger is positioned for engagement by the object prior to engagement of the first trigger by the object.

4. The toy vehicle playset of claim 3, wherein the second trigger is configured to, in an uncocked state, allow engagement of the first trigger by the object.

5. The toy vehicle playset of claim 1, wherein the pivotal portion is spring biased.

6. A vehicle playset, comprising:

a track having a main section and a pivotal section, the main section including an exit portion and a re-entry portion, the pivotal section including a first end and a second end, the first end of the pivotal section being connected to the exit portion of the main section and the second end of the pivotal section being connected to the re-entry portion of the main section;

a projection coupled to the first end of the pivotal section;

a latching mechanism retaining the pivotal section in a position relative to the main section; and a trigger positioned along the track and configured to interact with an object passing along the track, wherein activation of the trigger results in the release of the latching mechanism, thereby allowing the pivotal section to rotate relative to the main section, the projection engages the object when the pivotal section rotates relative to the main section, thereby flipping the object off the track.

7. The vehicle playset of claim 6, wherein the track includes a transition section positioned between the second end of the pivotal section and the re-entry portion of the main section of the track, and the trigger is positioned in the transition section of the track.

8. The vehicle playset of claim 7, wherein the trigger is a first trigger, and the vehicle playset further comprises:

a second trigger positioned in the pivotal section of the track, the second trigger being actuatable to release the latching mechanism and allow the pivotal section to relative to the main section to separate the object from the pivotal section of the track.

9. The vehicle playset of claim 8, wherein. the latch mechanism includes:

a latch provided on one of the pivotal section or the transition section; and a catch provided on the other of the pivotal section or the transition section and configured to ;selectively engage and disengage the latch.

10. The vehicle playset of claim 9, further comprising:

a spring-biased hinge that rotatably couples the second end of the pivotal section to the transition section, wherein the hinge is operatively coupled to the latch mechanism such that the hinge is selectively restrained by engagement of the latch and the catch, and released by disengagement of the latch and the catch.

11. The vehicle playset of claim 8, wherein each of the first trigger and the second trigger has a cocked state in which engageable of one of the triggers by the object triggers movement of the pivotal section of the track, and an un-cocked state in which movement of the pivotal section is not triggered as the object passes along the track.

12. The vehicle playset of claim 11, wherein the second trigger is positioned on the track so as to interact with the object prior to the object interacting with the first trigger.

13. A method of using a toy vehicle play set, the toy vehicle playset including a track with a main section and a pivotal section, the track including a trigger coupled thereto, the method comprising:

cocking the trigger positioned along the track;

guiding an object from the main section of the track to the pivotal section of the track;

detecting a triggering action generated as the object moves along the track and rotating the pivotal section away from the main section of the track in response to the detected triggering action; and pinning the object to the main section of the track.

14. The method of claim 13, wherein rotating the pivotal section away from the main section of the track in response to the triggering action includes:

in response to the detected triggering action, releasing a latch disposed at one of the pivotal section or a transition section of the track from a catch disposed at the other of the pivotal section or the transition section of the track, the transition section being positioned between an end portion of the pivotal section and a re-entry portion of the main section of the track; and rotating a first end of the pivotal section about a hinge at a second end of the pivotal section, the first end being positioned adjacent to an exit portion of the main section of the track and the second end of the pivotal section being positioned adjacent to the transition section of the track, so as to separate the first end of the pivotal section of the track from the exit portion of the main section of the track.

15. The method of claim 14, wherein pinning the object to the track includes:

detecting a first triggering action; and in response to the first triggering action, rotating the projection together with the pivotal section of the track, and pinning the object between a distal end of the projection and the track, with the distal end of the projection positioned on a top of the object, and the object positioned on the track.

16. The method of claim 15, wherein detecting a first triggering action includes detecting an interaction between the object and a first trigger positioned in the transition section of the track, the first trigger being in a cocked state, as the object passes through the transition section.

17. The method of claim 15, the triggering action being a first triggering action, the method further comprising:

detecting a second triggering action; and in response to the second triggering action, rotating the pivotal section of the track as the object moves along the pivotal section of the track and launching the object from the pivotal section of the track.

18. The method of claim 17, wherein detecting a second triggering action includes detecting an interaction between the object and a second trigger positioned in the pivotal section of the track, the second trigger being in a cocked state, as the object passes through the pivotal section.

19. The method of claim 13, wherein detecting a triggering action generated as the object moves along the track includes:

detecting a first triggering action in response to an interaction of the object with a pinning trigger positioned in the transition section of the track as the object passes through the transition section of the track with the pinning trigger in a cocked state; and detecting a second triggering action in response to an interaction of the object with a separating trigger positioned in the pivotal section of the track as the object passes through the pivotal section of the track with the separating trigger in a cocked state.

20. The method of claim 19, further comprising separating the object from the pivotal section of the track in response to actuation of the separating trigger, and pinning the object between the projection and the track in response to actuation of the pinning trigger.

* * * * *